US005458514A

United States Patent [19]

Hsia

[11] Patent Number: 5,458,514

[45] Date of Patent: Oct. 17, 1995

[54] SURFBOARDS WITH PADDLERS

[76] Inventor: Chih-Yu Hsia, 301 Warren Way, Arcadia, Calif. 91006

[21] Appl. No.: 370,399

[22] Filed: Jan. 9, 1995

[51] Int. Cl.[6] ..... A63C 15/03

[52] U.S. Cl. ..... 441/77; 440/21

[58] Field of Search ..... 441/74, 77; 440/13, 440/17, 19, 21, 22, 23, 24, 25, 26, 27, 28, 29, 30, 31, 32

[56] References Cited

U.S. PATENT DOCUMENTS

| | | | |
|---|---|---|---|
| 2,297,496 | 9/1942 | Pomilio | 440/17 |
| 3,242,898 | 3/1966 | Livaudais | 441/77 |
| 3,377,977 | 4/1968 | Malm | 440/13 |
| 3,833,956 | 9/1974 | Meehan | 441/76 |
| 4,936,802 | 6/1990 | Ueno | 440/21 |

FOREIGN PATENT DOCUMENTS

| | | | |
|---|---|---|---|
| 3802238 | 3/1989 | Germany | 441/74 |

*Primary Examiner*—Stephen Avila
*Attorney, Agent, or Firm*—William W. Haefliger

[57] ABSTRACT

In a surfboard assembly, the combination comprises a longitudinally forwardly elongated structure including flotation means, and having opposite ends; and means carried by the structures to support one foot of a surfer or to be manually operated by the other foot of the surfer to propel the surfboard assembly forwardly.

9 Claims, 16 Drawing Sheets

SURFBOARDS WITH PADDLERS

BACKGROUND OF THE INVENTION

This invention relates to devices which enable a surfer to propel his/her surfboard in the water; and more particularly it relates to improvements in propulsion mechanisms, for such purposes.

In the past, a surfer would lie down on a surfboard to propel the surfboard with hands and arms, as towards the sea to catch a surf. There is need for a means by which the surfer can propel the surfboard with his/her feet. The present device enables a surfer to travel with his/her surfboard, easily, using legs and feet for propulsion.

SUMMARY OF THE INVENTION

The invention basically comprises:

a) longitudinally forwardly elongated structure including flotation means, and having opposite ends, and b) means carried by said structures to i) support one foot of a surfer, and ii) to be manually operated by the other foot of the surfer to propel the surfboard assembly forwardly.

As will be seen, said means includes foot operated paddlers at opposite sides of the elongated structure, and each movable between lowered position in which the paddle pushes rearwardly against water resistance to a raised position in which the paddle moves relatively forwardly. A link is pivotably carried by said structure and interconnects said paddlers; and foot rests are located above the paddler and to which the link has pivotal interconnection.

Another object is to provide a paddler controller located frontwardly of one raised paddles and projecting downwardly into the water. The paddler controller typically has an upper position projecting above a top level of said structure and angled to be foot operated to raise and lower that controller. Two such controllers are typically provided, one associated with each paddle, and movable forwardly and rearwardly with its associated foot rest. Each paddle has pivotal connection to a foot rest, to pivot about a generally horizontal axis.

DRAWING DESCRIPTION

FIG. 1, FIG. 2 and FIG. 3 constitute a plan view, a side view, and an elevation view, respectively, of a paddler;

FIG. 4, FIG. 5 and FIG. 6 constitute a plan view, a side view, and an elevation view, respectively, of a paddle;

Figure 13:
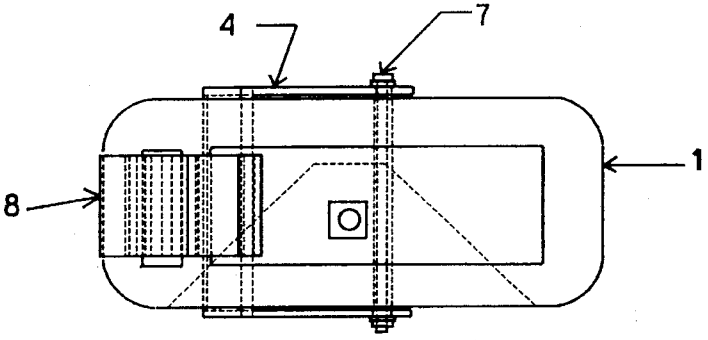
Figure 10:
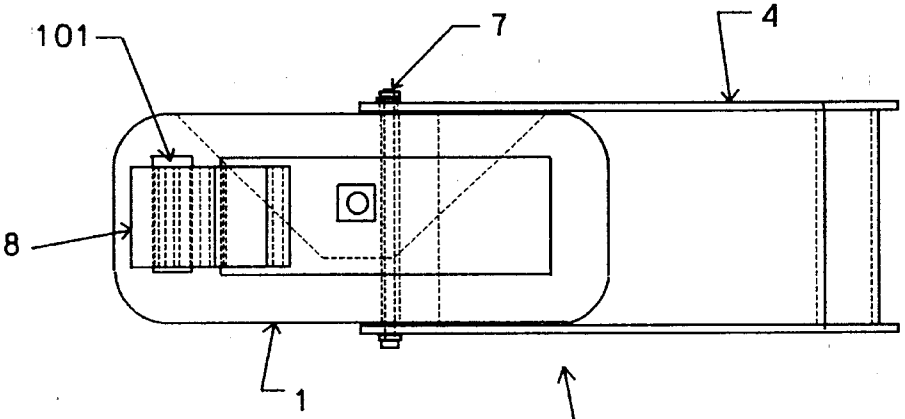
Figure 14:
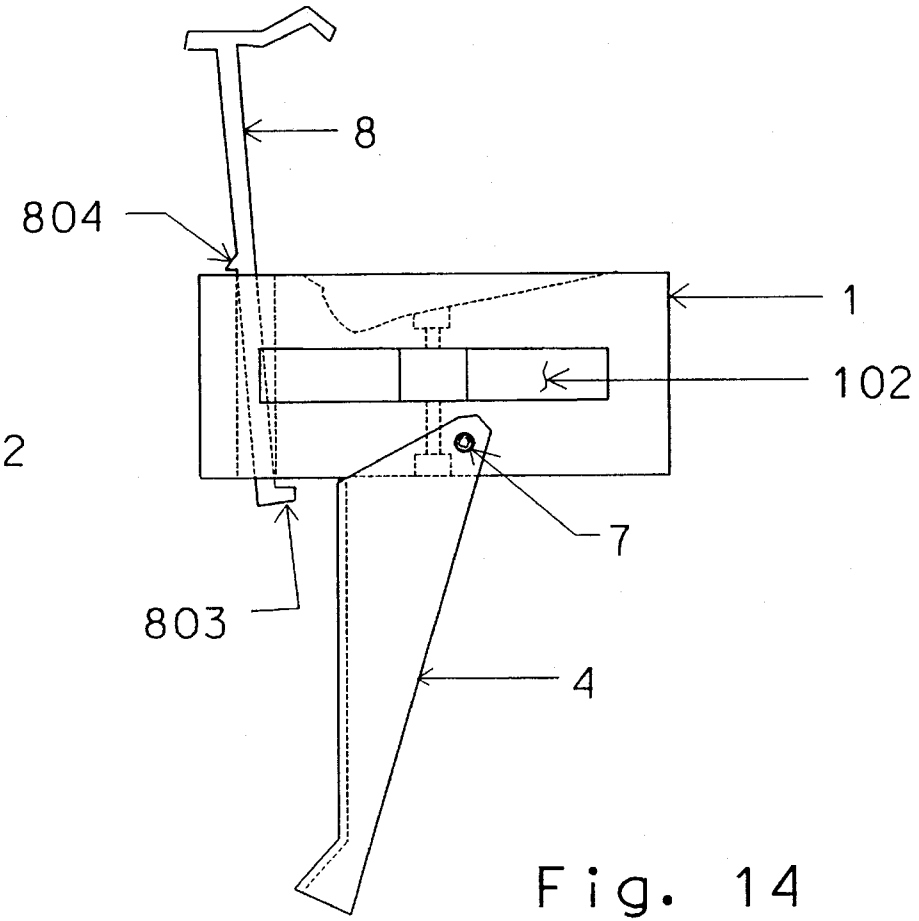
Figure 12:
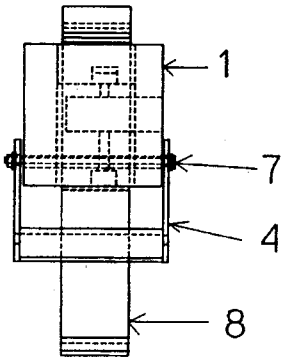
Figure 15:
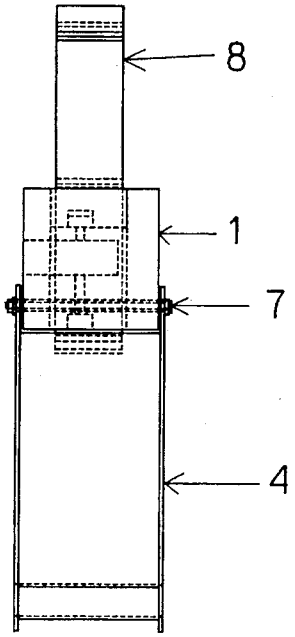
Figure 46:
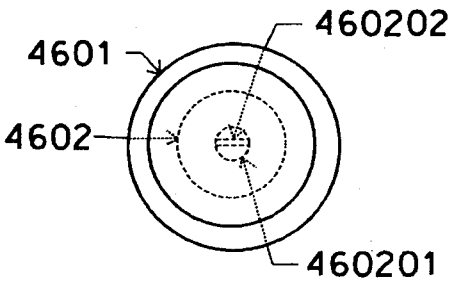
Figure 50:
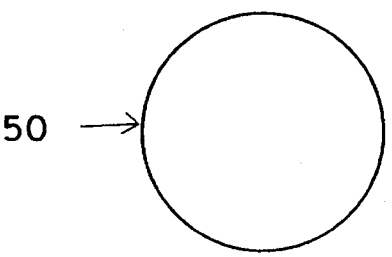
Figure 48:
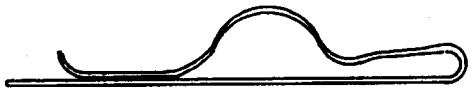
Figure 31:
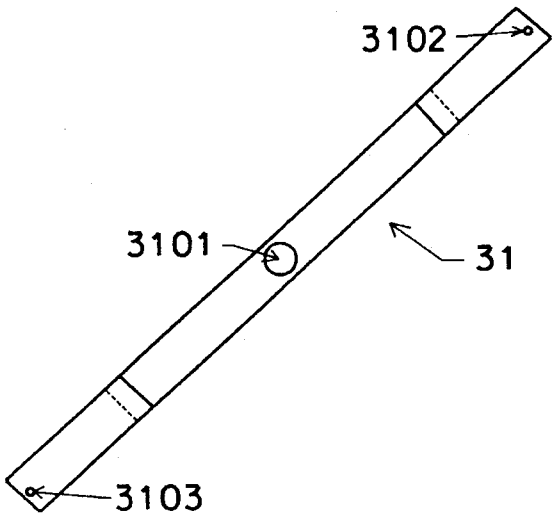
Figure 16:
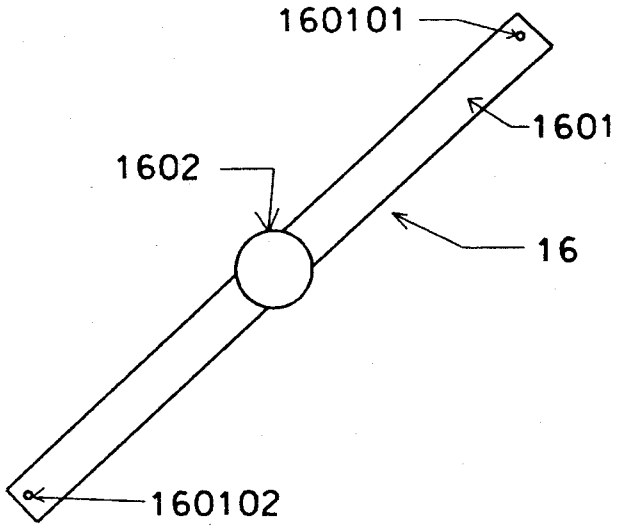
Figure 32:
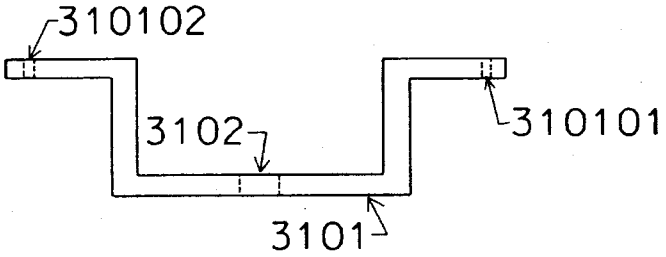
Figure 51:
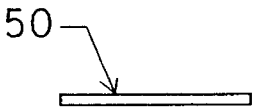
Figure 49:
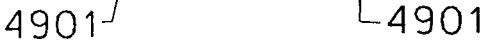
Figure 47:
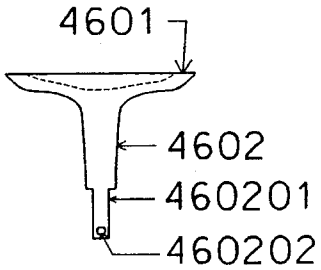
Figure 17:
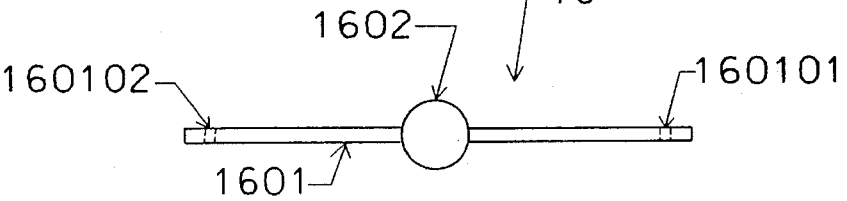
Figure 11:
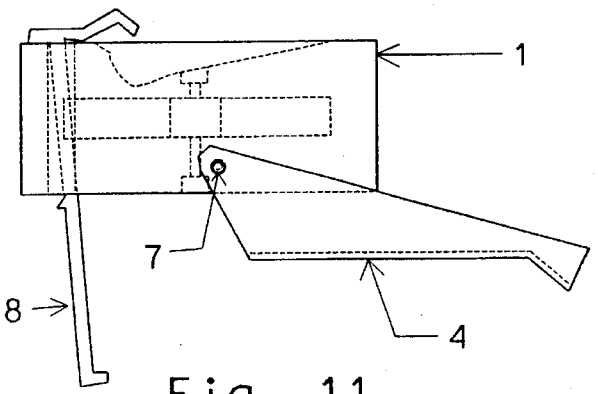
Figure 41:
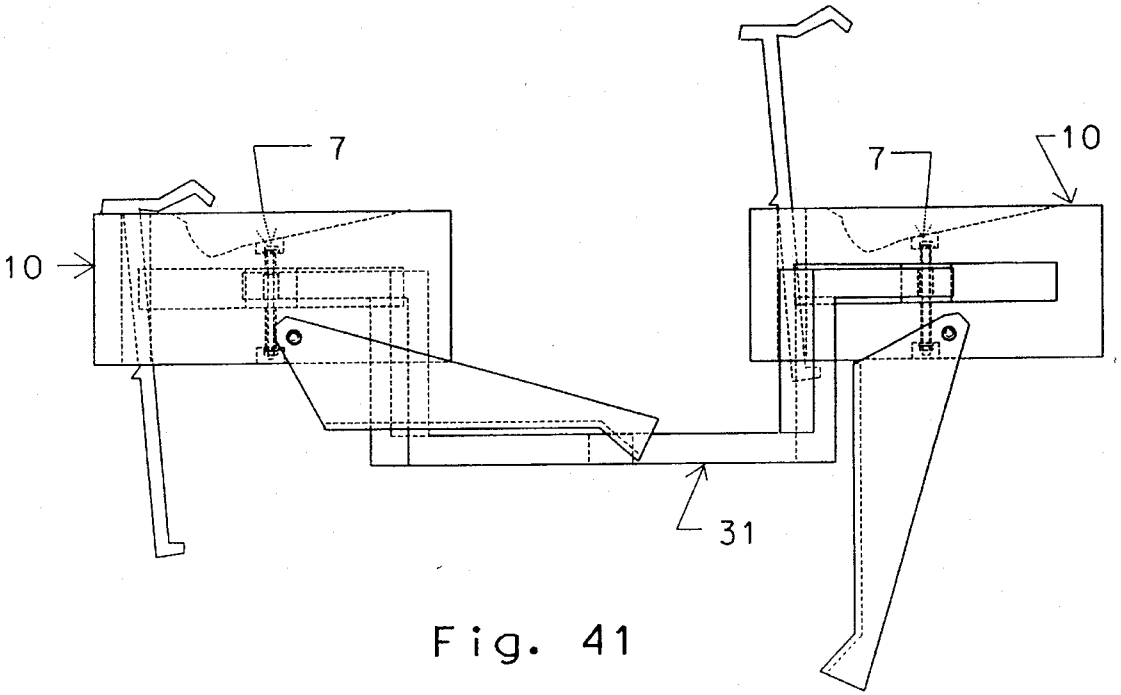
Figure 24:
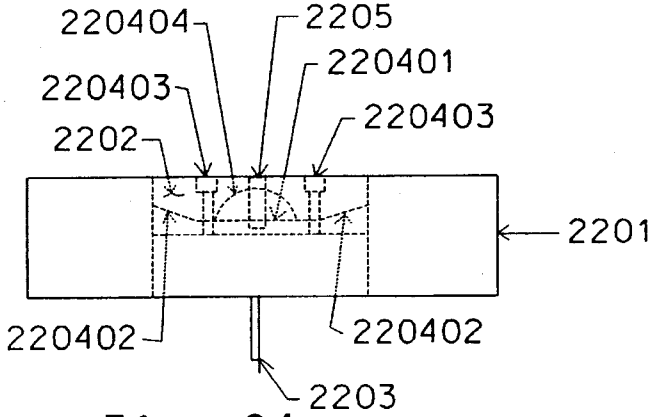
Figure 33:
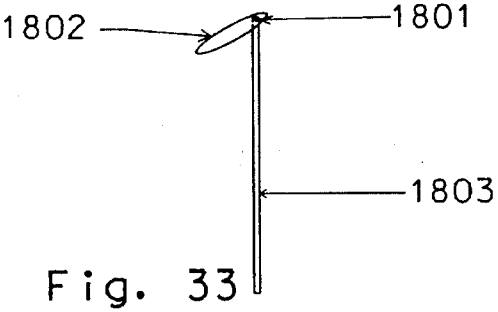
Figure 18:
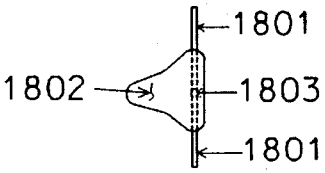
Figure 36:
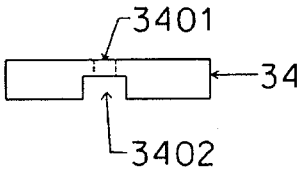
Figure 39:
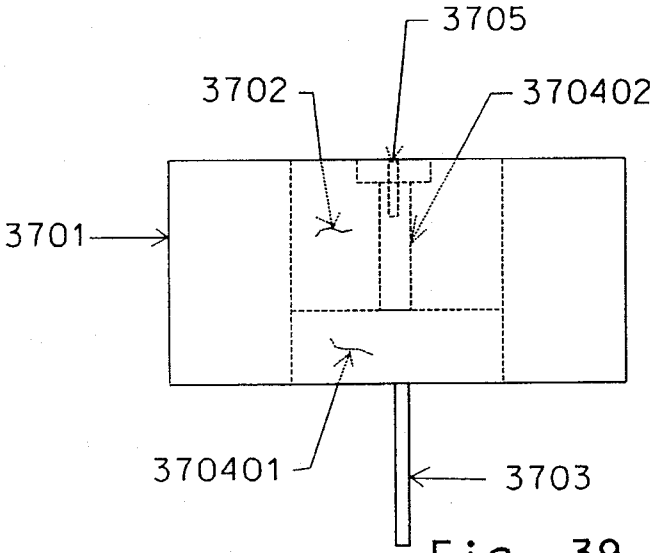
Figure 27:
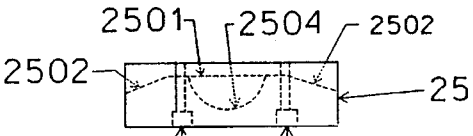
Figure 40:
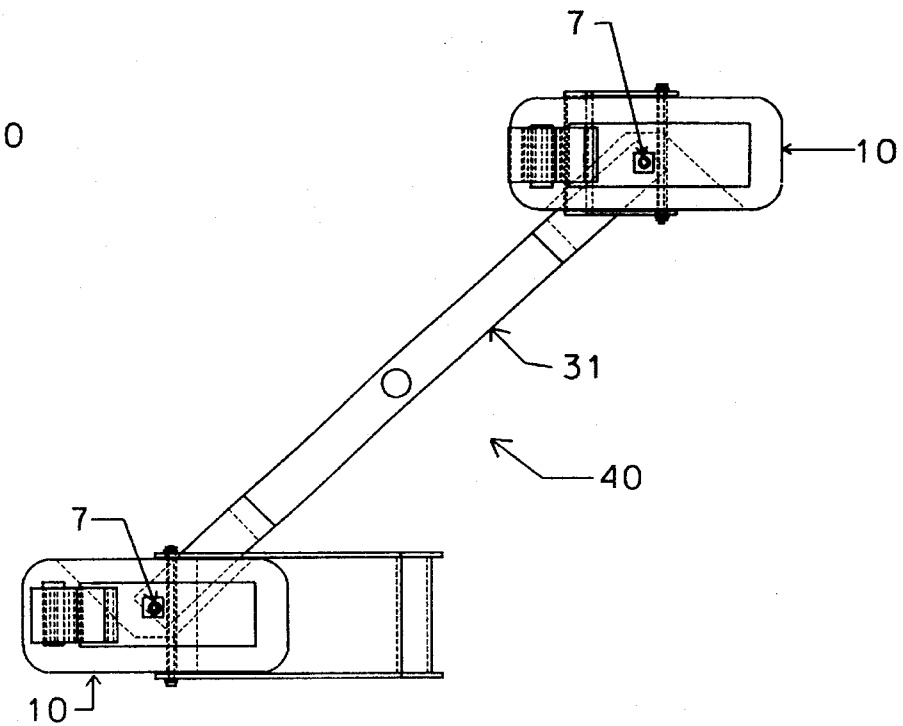
Figure 19:
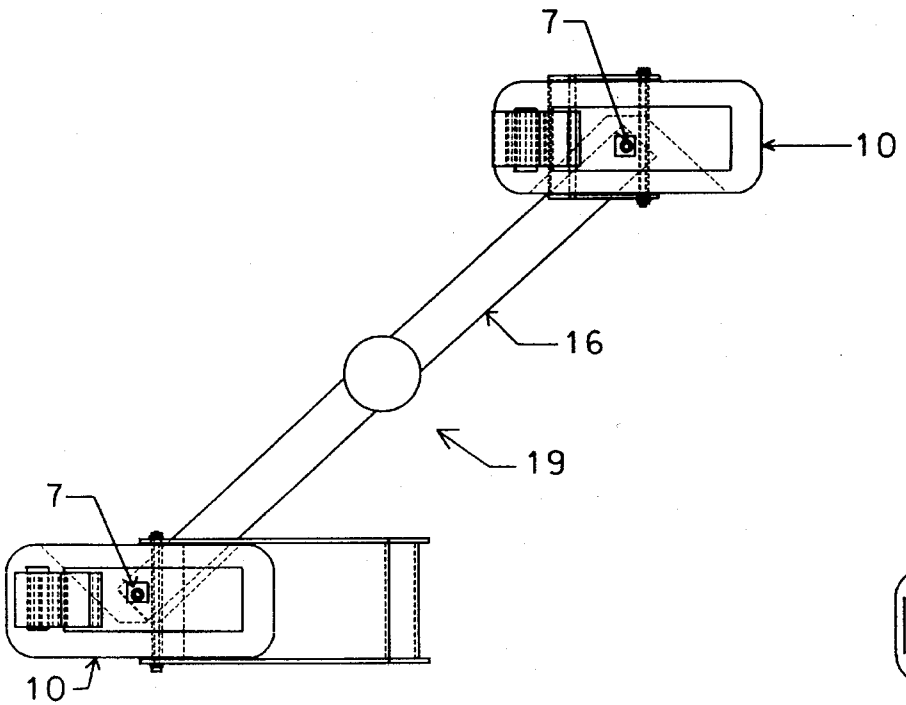
Figure 52:
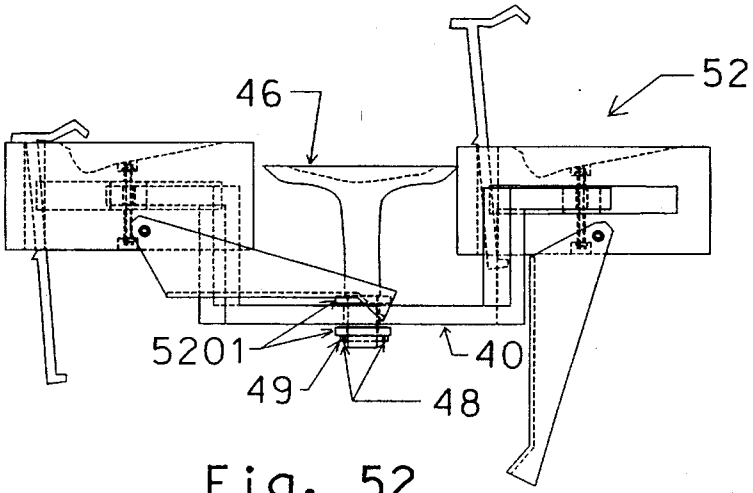
Figure 20:
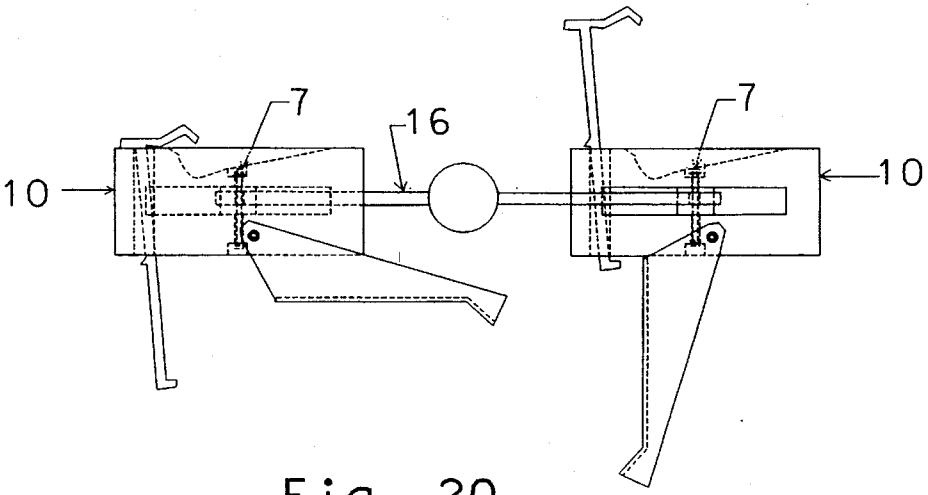
Figure 42:
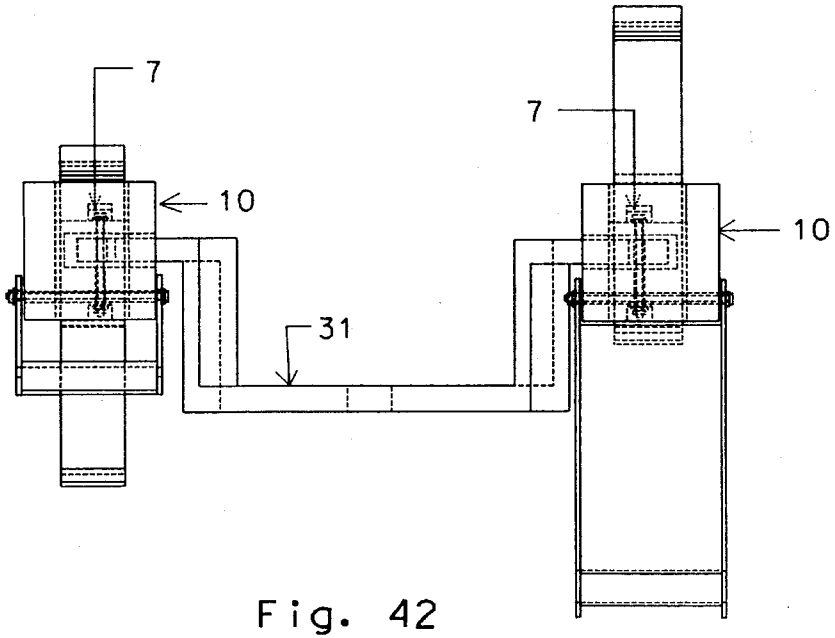
Figure 21:
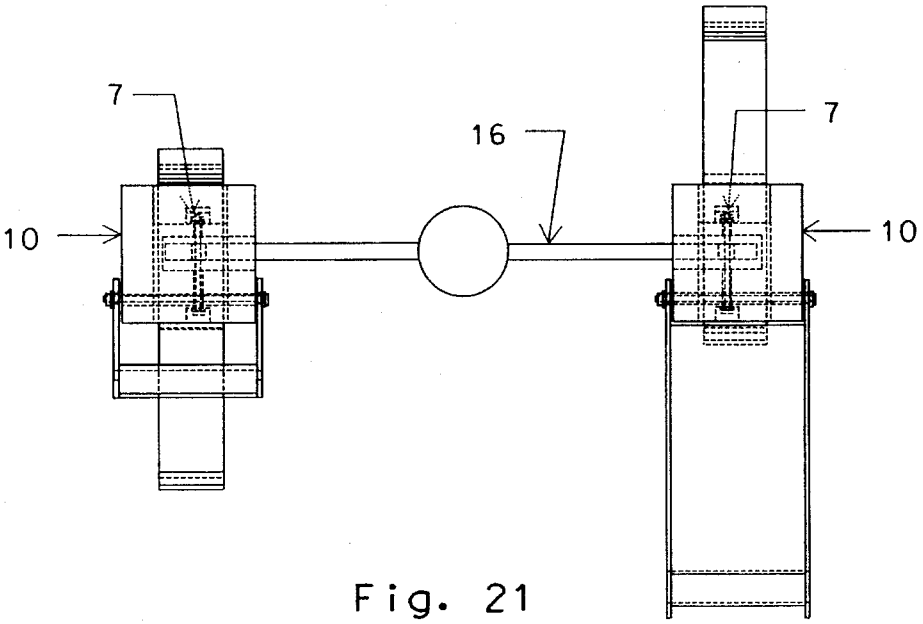
Figure 37:
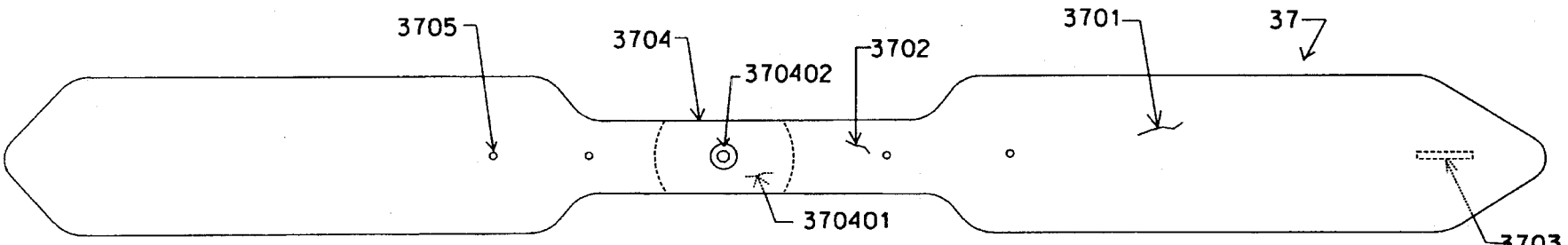
Figure 34:
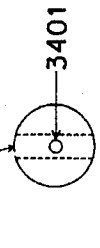
Figure 25:
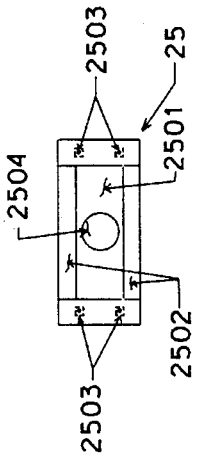
Figure 22:
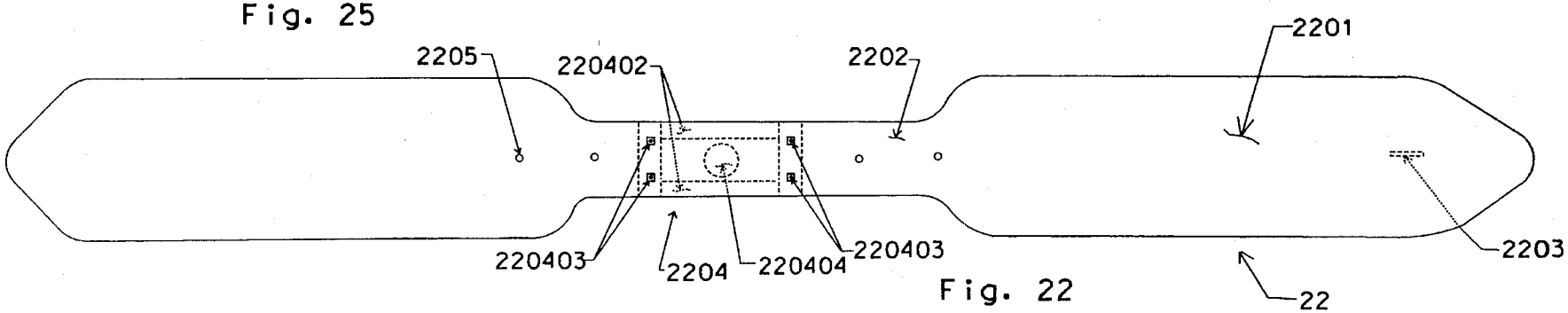
Figures 23, 26, 35, 38:
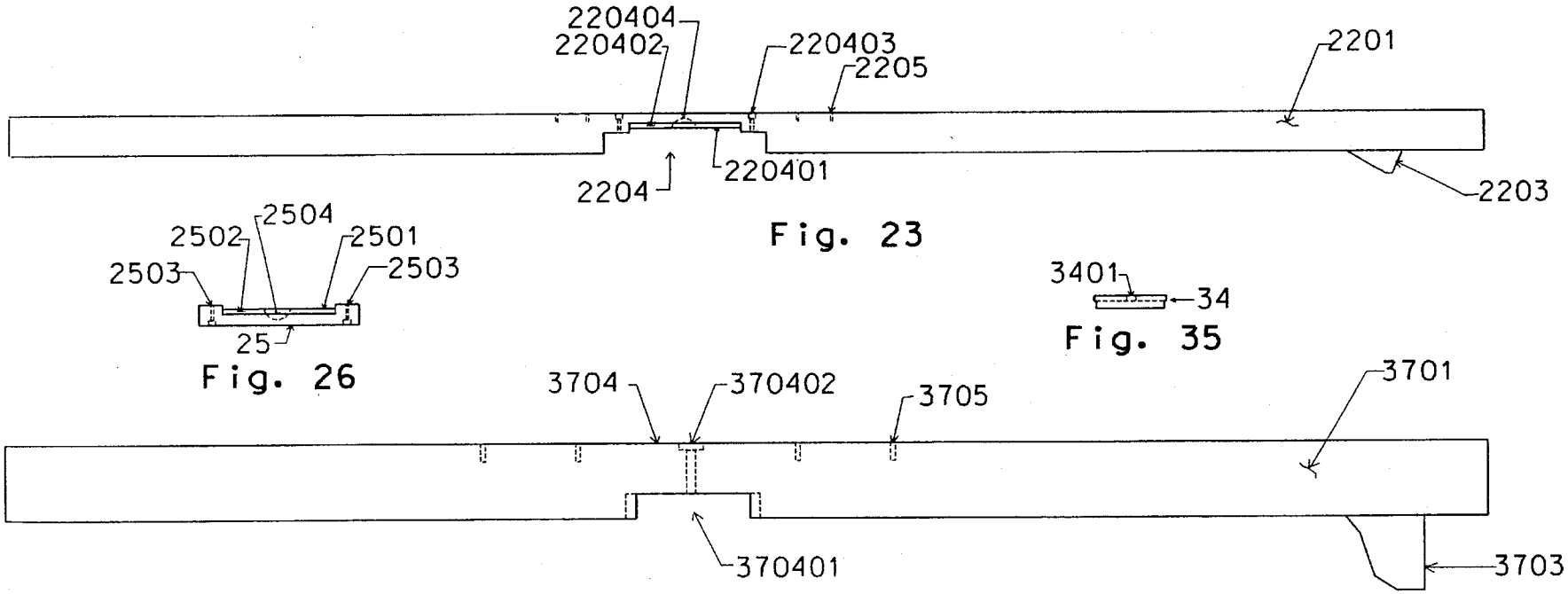
Figures 28, 43, 53:
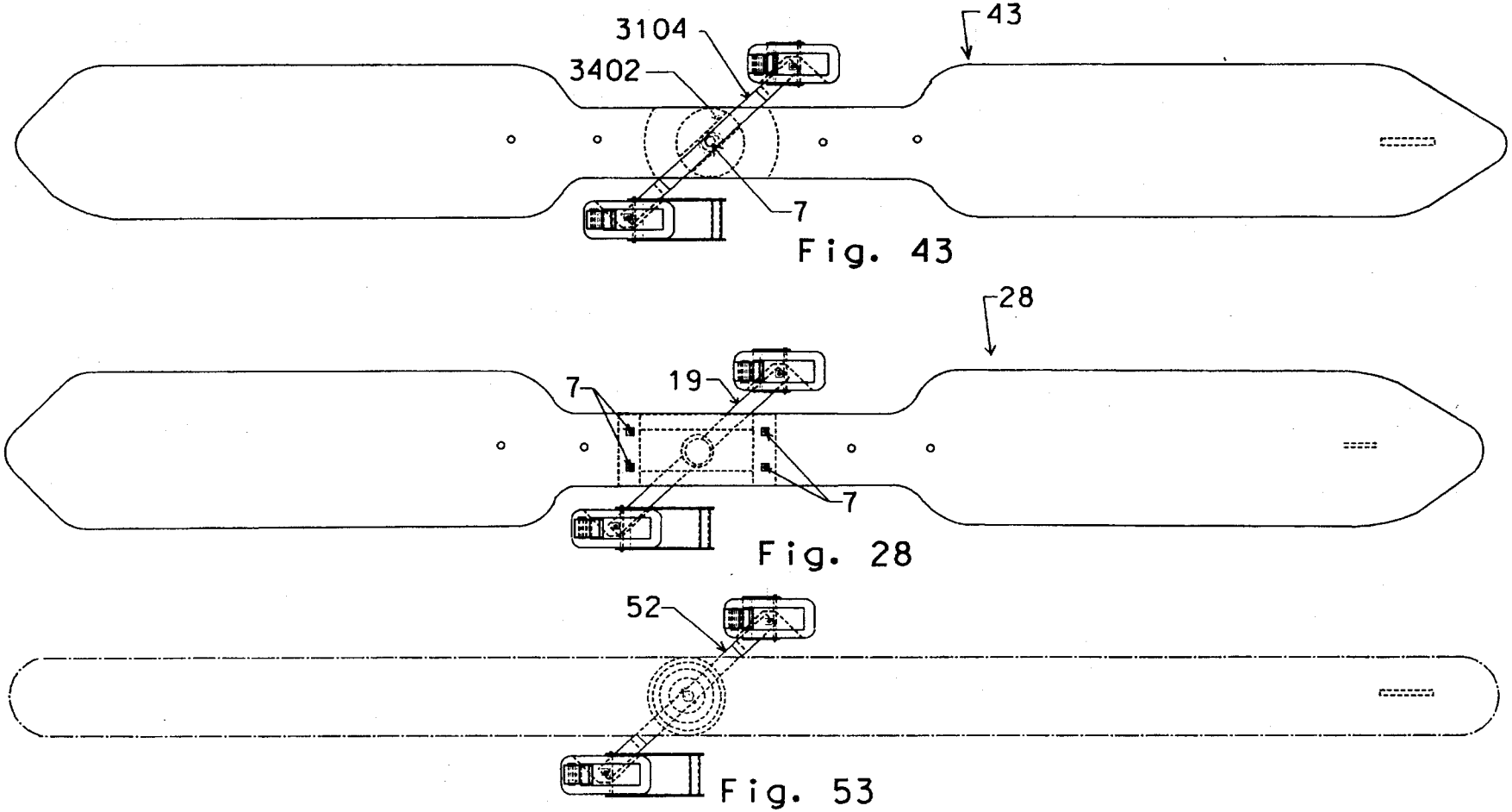
Figures 29, 44, 54:
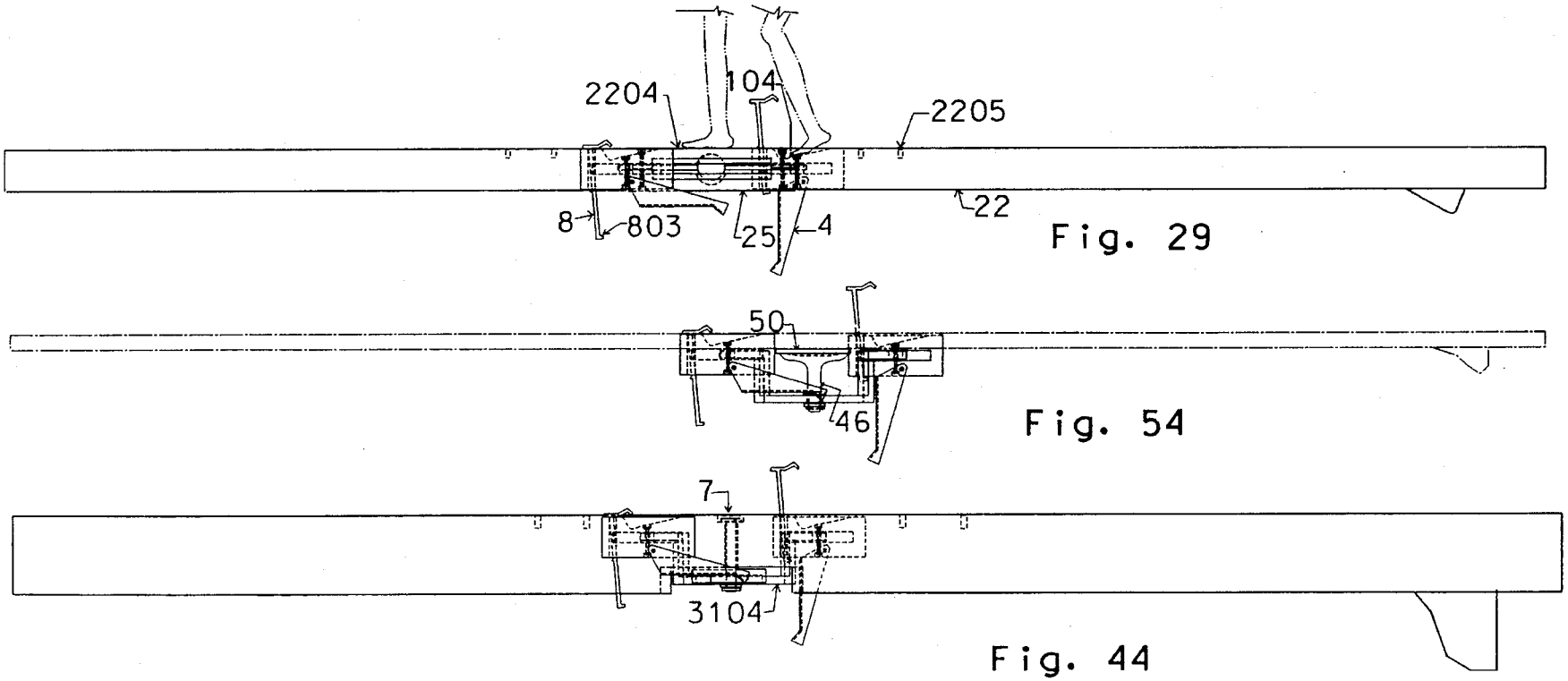
Figure 30:
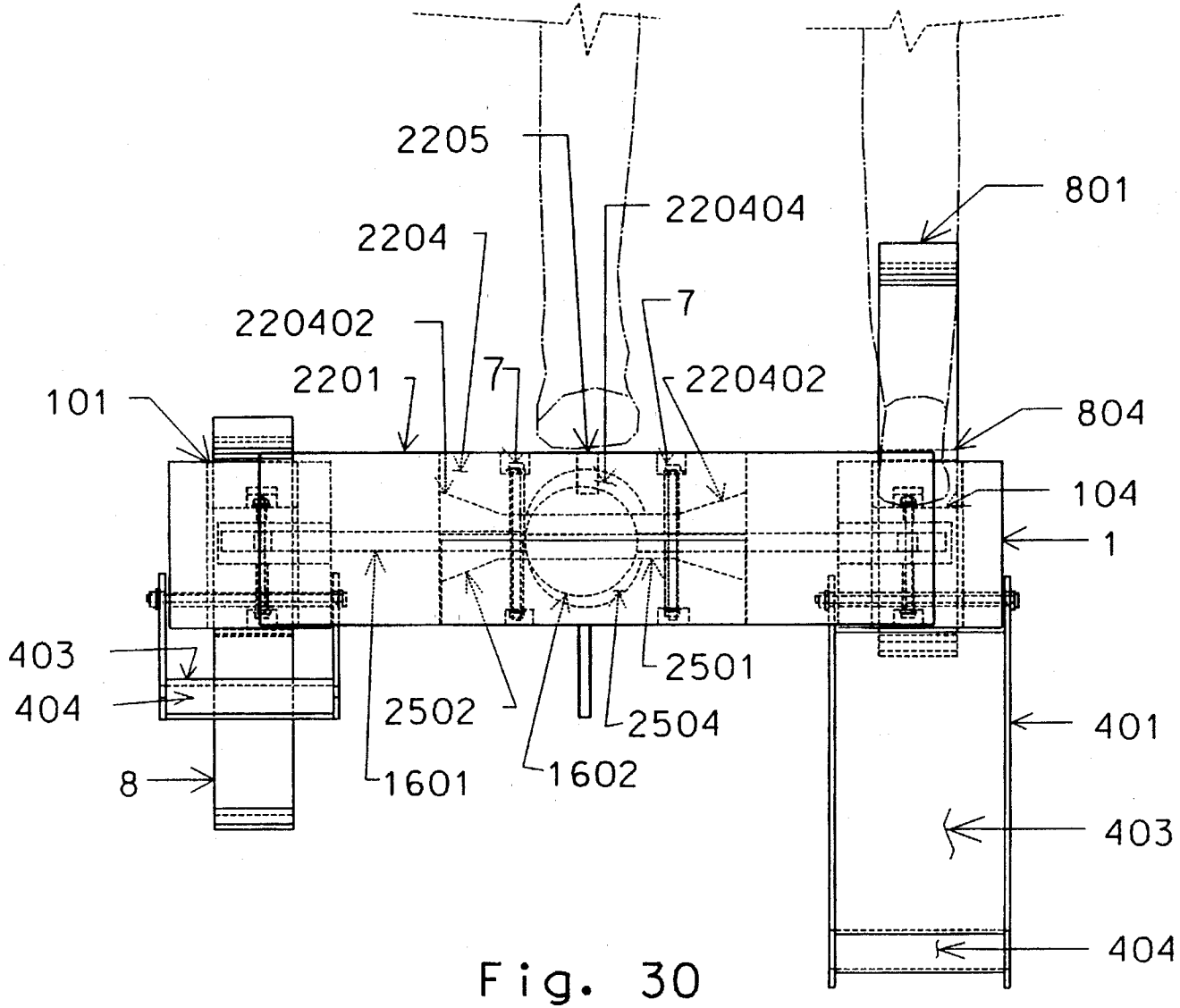
Figure 45:
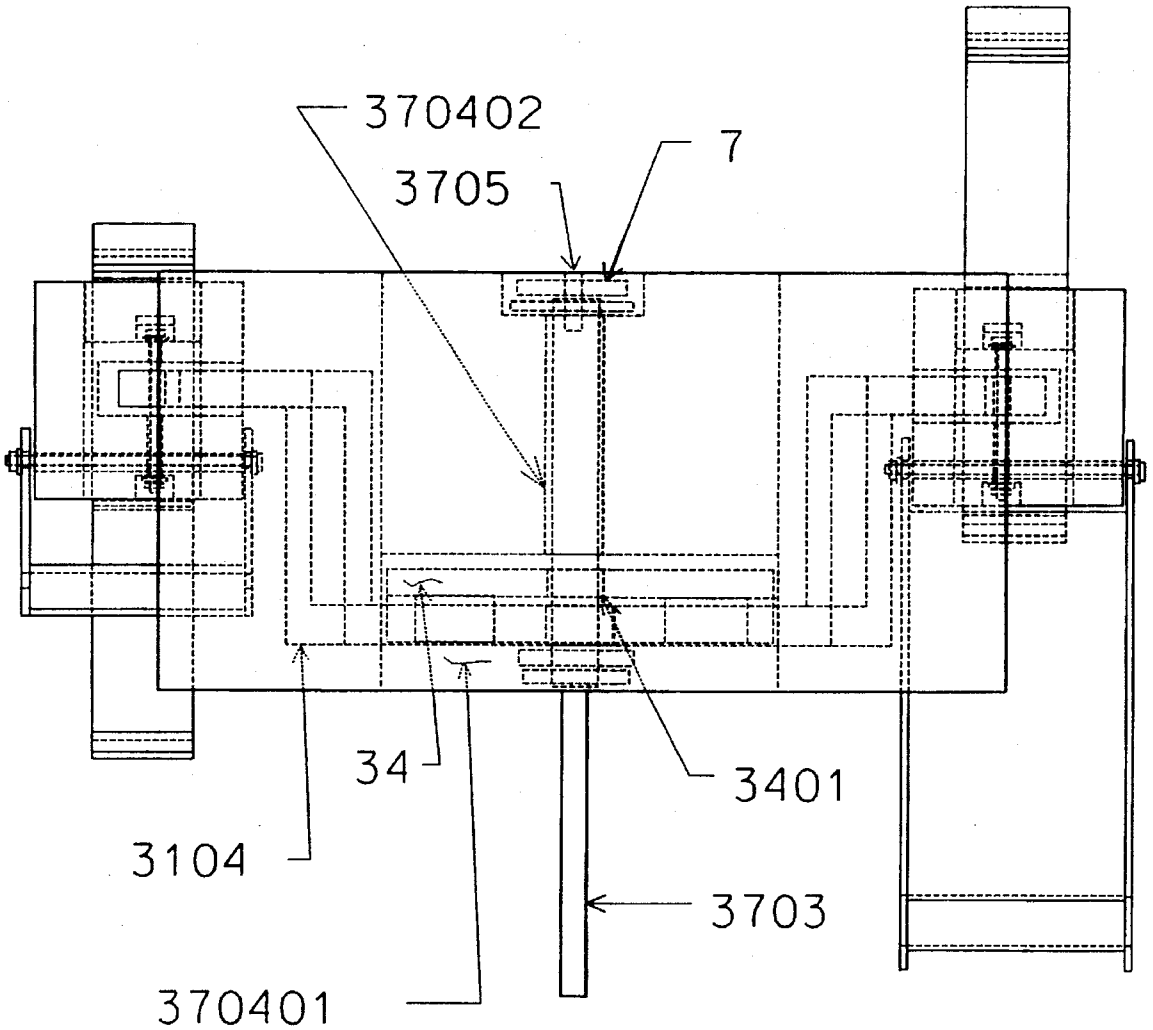

FIG. 10, FIG. 11 and FIG. 12 are a plan view, a side view, and an elevation view, respectively, of a paddler assembly including a paddler controller, a paddle and a paddler. In this paddler assembly, the paddler controller and the paddle are shown in "low position" and "non-functional position", respectively, FIG. 13, FIG. 14 and FIG. 15 are a plan view, a side view, and an elevation view, respectively, of a paddler assembly including a paddler controller, a paddle and a paddler. In this paddler assembly, the paddler controller and the paddle are shown in "high position" and the "functional position", respectively;

FIG. 16 and FIG. 17 are a plan view and a side view, respectively, of the first form of paddlers link;

FIG. 18 and FIG. 33 are a plan view and an elevation view, respectively, of an optional surfboard seat/handle;

FIG. 19, FIG. 20 and FIG. 21 are a plan view, a side view, and an elevation view, respectively, of a form of paddler-link assembly which includes a first form of paddlers link connecting with two sets of paddler assemblies;

FIG. 22, FIG. 23 and FIG. 24 constitute a plan view, a side view, and an elevation view, respectively, of a first form of a modified surfboard;

FIG. 25, FIG. 26 and FIG. 27 are a plan view, a side view, and an elevation view, respectively, of a first form of paddler's link lower mounting seat;

FIG. 28, FIG. 29 and FIG. 30 are a plan view, a side view, and an elevation view, respectively, of a completed assembly of surfboard with paddlers. FIG. 29 and FIG. 30 also illustrate uses of the invented devices. The optional surfboard handle/seat are not shown in these two figures;

FIG. 31 and FIG. 32 are a plan view and a side view, respectively, of a second form of paddler's link;

FIG. 34 and FIG. 36 are a plan view, a side view, and an elevation view, respectively, of a second form of paddler's link lower mounting seat;

FIG. 35 is a section view;

FIG. 37, FIG. 38 and FIG. 39 are a plan view, a side view, and an elevation view, respectively, of a second form of modified surfboard;

FIG. 40, FIG. 41 and FIG. 42 are a plan view, and an elevation view, respectively, of a second form of paddler-link assembly, which includes a second form of paddler's link connecting with two sets of paddler assemblies;

FIG. 43, FIG. 44 and FIG. 45 are a plan view, a side view, and an elevation view, respectively, of a completed assembly of a second form of surfboard with paddlers;

FIG. 46 and FIG. 47 are a plan view and a side view of a third form of paddler's link mounting part;

FIG. 48 is a schematic view of a pin;

FIG. 49 is a schematic view of a mounting rod;

FIG. 50 and 51 are a plan view and a side view of a mounting pad, respectively;

FIG. 52 is a side view of a third form of paddler-link assembly which includes a third form of paddler's link mounting part and a second form of paddlers link connecting with two sets of paddler assemblies; and FIG. 53 and FIG. 54 are a plan view and a side view, respectively, of a completed assembly of a third form of surfboard with paddlers.

DETAILED DESCRIPTION

Figure 6:
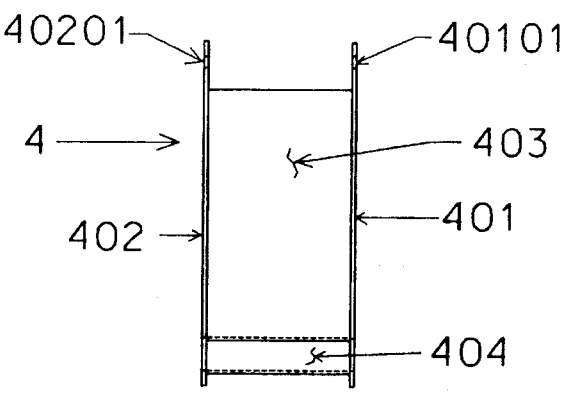
Figure 4:
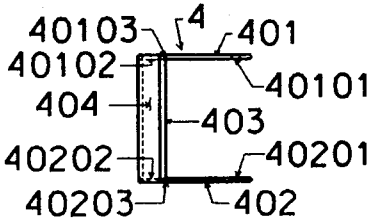
Figure 5:
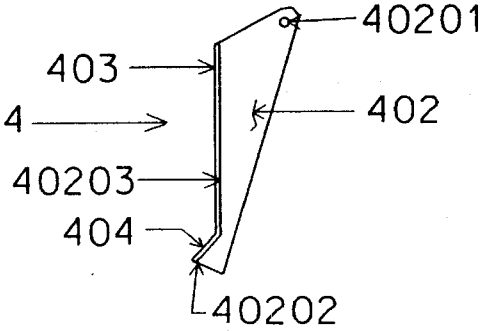

Referring to FIGS. 4, 5 and 6, a paddle 4 comprises two side plates, 401 and 402, a back plate 403, and a tilt-up plate 404. The side plates, the back plate and the tilt-up plate all have flat plate form. There is a hole, 40101 and 40102, for plates 401 and 402, respectively, at one corner of each plate. There is a straight edge 40102 and 40202, respectively, for 401 and 402, at the other corner of each plate. Connecting with this extruding edge is another straight edge, 40103 and 40203, for 401 and 402, respectively, for each side plate. Two edges of the back plate 403 connect with the straight edges 40103 and 40203. Two edges of the tilt-up plate connect with the edges 40102 and 40202.

Figure 9:
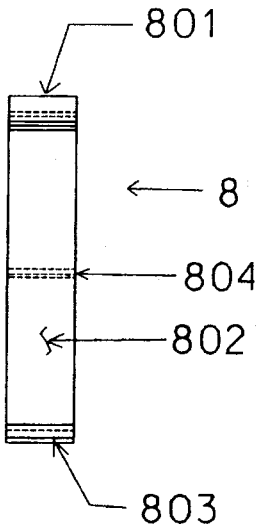
FIG. 8 and FIG. 9 are a side view and an elevation view, respectively, of a paddler controller.
Figure 7:
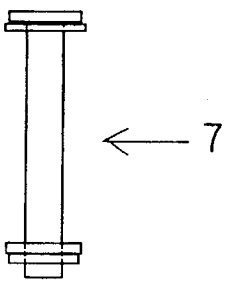
FIG. 7 is a schematic side view of a self-locking bolt-nut-washer set.
Figure 8:
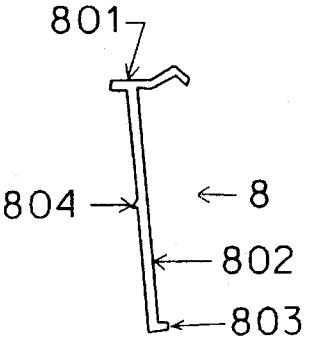

Referring to FIGS. 8 and 9, a paddler controller 8 comprises a paddler controller head 801, a paddler controller web 802, a paddler controller foot 803, and a paddler controller rest 804. The paddler controller head and the paddler controller web constitute plates. The paddler controller foot and the paddler controller rest are short stubs extending from the paddler controller web. The paddler controller head, the paddler controller foot and the paddler controller rest extend from said one end, said other end, and the middle portion, of the paddler controller web, respectively.

Two forms of paddler's link, i.e. the first form of paddler's link and the second form of paddler's link are employed. Referring to FIGS. 16 and 17, the first form of paddlers link 16 consists of a link arm 1601 and a link ball 1602. The ball is a sphere from which radially extends the link arm, which is a plate. There are two holes 160101 and 160102 in the two ends of the link arm. Referring to FIGS. 31 and 32 the second form of paddler's link 31 is a "U" shape plate, namely link arm 3104, with a link bolt hole 3101 near its longitudinal center and two holes 3102 and 3103 at each end.

Figure 1:
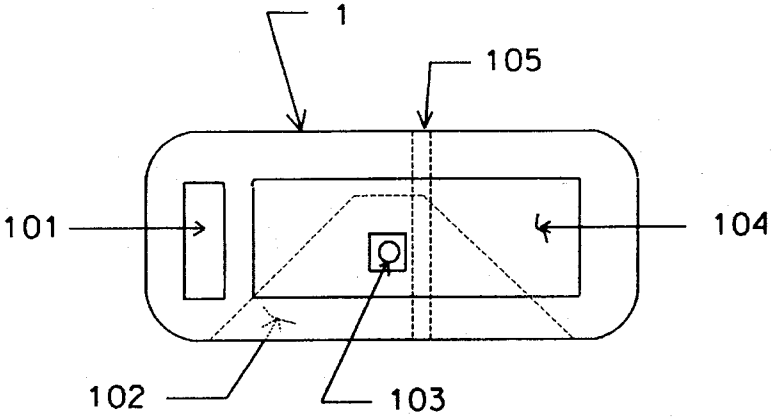
Figure 2:
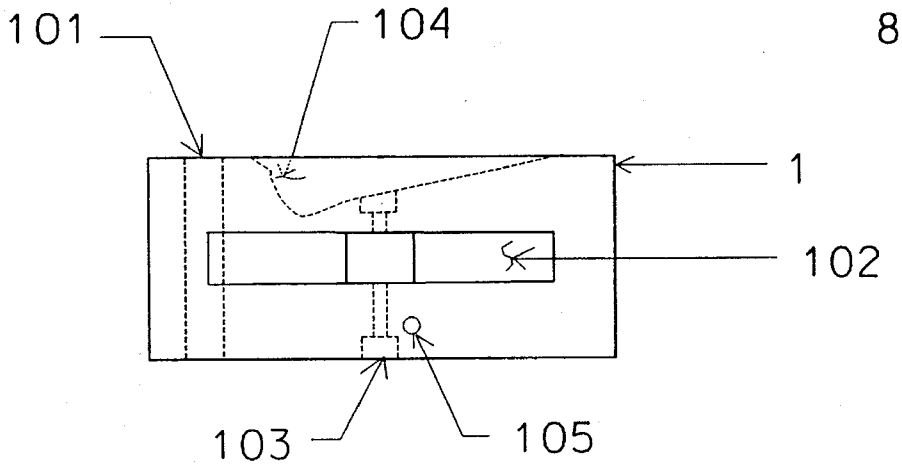
Figure 3:
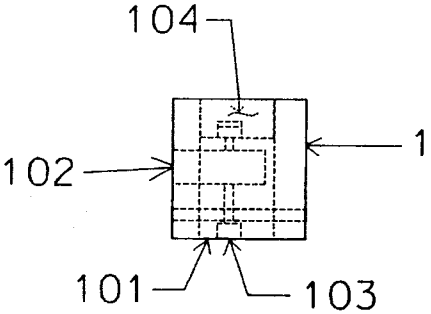

Referring to FIGS. 1, 2 and 3, a paddler 1 basically comprises a block, with a control slot 101 penetrating from top to bottom, a slot 102 on its side, a fastening hole 103 penetrating from top to bottom, a foot contour 104 on the top, and a paddle fastening hole 105 extending sideways. The slot receives the paddler controller web 802, paddler controller foot 803, and the paddler controller rest 804, but not the paddler controller head 801. The paddler's link slot allows the first form of paddler link arm 1601 and the second form of paddler's link arm 3104 to penetrate therein. The paddlers link fastening hole 103 has enlarged ends for a bolt head or a nut. The foot contour 104 forms a depressed area for a surfer's foot to easily and comfortably operate the paddler.

Referring to FIGS. 10, 11, 12, 13, 14 and 15, a paddler assembly 10 includes a paddler 1, a paddle 4, a paddler controller 8 and a bolt-nut-washer set 7. The paddle is mounted on the paddler with the bolt-nut-washer set used for connection via the hole 40101, the paddle fastening hole 105, and the hole 40201. The paddle can pivot on the bolt-nut-washer set. The paddle can be in a "non-functional" position, as that shown in FIGS. 10, 11 and 12, or in a "functional" position, as that shown in FIGS. 13, 14 and 15. In general, at the "non-functional" position, the back plate 403 is in substantially horizontal position. At "functional" position, the back plate 403 is in near vertical position. When the paddler is not in use, the buoyancy of the paddle causes the paddle to be in the "non-functional" position. The paddler controller 8 is placed into the paddler controller slot 101. The paddler controller can be in a "low" position, as those shown in FIGS. 10, 11 and 12, or in a "high" position, as shown in FIGS. 13, 14 and 15. When the paddler controller rest 804 seats on the rim of the paddler controller slot 101, the paddler controller is in "high" position. When the bottom of the paddler controller head 801 seats on the rim of the paddler controller slot 101, the paddler controller is in "low" position.

Referring to FIGS. 19, 20 and 21, the first form of paddler-link assembly 19 consists of two paddler assemblies 10, which are mirror images of each other, a first form paddler's link 16, and a pair of self-locking bolt-nut-washer sets 7. Each end of the first form paddler's link arm 1601 penetrates into each paddler's link slot 102 of each paddler assembly. Each bolt of the bolt-nut-washer set penetrates the paddler's link fastening hole 103 and the hole 160101, or 160102, and the set connects the paddler assembly and the first form paddler's link together. Each paddler assembly can pivot on a bolt-nut-washer set. The maximum angles about which the paddler assembly can pivot are limited by the edges of the paddler's link slot.

Referring to FIGS. 22, 23 and 24, a first form modified surfboard 22 consists of a modified board 2201, a narrowed waist 2202, an optional fin 2203, a paddler's link upper mounting seat 2204, and one or more optional seat/handle mounting hole(s) 2205. The modified surfboard has elements 2202, 2203, 2204 and 2205 as referred to. The narrowed waist is a narrow portion in the middle section of the modified surfboard. Near the middle of the narrowed waist is located the paddler's link upper mounting seat, the bottom of which is shallower than the rest of the narrowed waist. The paddler's link upper mounting seat has a paddler's link upper recessed surface 220401, a pair of paddler's link upper mounting seat inclined surfaces 220402, several paddlers link upper mounting seat mounting holes 220403, and a paddler's link ball upper seat 220404. The paddler's link upper recessed surface is a recessed surface on the bottom of the paddler's link upper mounting seat. The paddler's link ball upper seat is a concave surface near the middle of the paddler's link upper recessed surface. Each of the two paddler's link upper mounting seat inclined surfaces is connected with the outer edge of the paddler's link upper recessed surface, which is shown tilting upwards. The paddler's link upper mounting seat mounting holes 22043 are outside of the paddler's link upper recessed surface and the paddler's link upper mounting seat inclined surfaces. The upper end of each of the paddler's link upper mounting seat mounting holes has an enlarged area into which a bolt head, a nut and/or washer can fit. The optional seat/handle mounting hole is a hole with or without female screw threads, and is on the center line of the top of the modified surfboard. The optional fin is a fin on the bottom of the modified surfboard.

Referring to FIGS. 18 and 33, a surfboard seat and handle combination consists of a pair of handles 1801, a seat 1802, and a rod 1803. The rod has one end connecting with the handles and the seat. The other end of the rod is either a plain end or an end with male screw threads. The handles are short rods extending from the end of the rod. The seat is at the end of the rod.

Referring to FIGS. 25, 26 and 27, the first form paddler's link lower mounting seat 25 basically is a block having a paddler's link lower recessed surface 2501, a pair of paddler's link lower mounting seat inclined surfaces 2502, several paddler's link lower mounting seat mounting holes 2503, and a paddler's link ball lower seat 2504. The paddler's link lower recessed surface is located on the top of the first form paddler's link lower mounting seat. The paddler's link ball lower seat is a concave surface near the middle of the paddler's link lower recessed surface. The two paddlers link lower mounting seat inclined surfaces are surfaces which are oppositely connected to an edge of the paddlers link lower recessed surface, which is tilted downward. The paddler's link lower mounting seat mounting holes comprise penetrating holes outside of the paddler's link lower recessed surface and the paddler's link lower mounting seat inclined surfaces. The lower end of each of the paddler's link lower mounting seat mounting holes has an enlarged area into which a bolt head, a nut and/or washer can fit.

Referring to FIGS. 28, 29 and 30, a first form surfboard with paddlers 28 consists of a first form modified surfboard 22, a first form paddler-link assembly 19, a first form paddler's link lower mounting seat 25, one or more optional surfboard seat and handle combinations 18, and several self-locking bolt-nut-washer sets 7. To assemble the first form surfboard with paddlers, the first form paddler's link ball 1602 of the first form paddler-link assembly 19 is placed into and is then surrounded by the paddler's link ball upper seat 220404 of the first form modified surfboard 22, and surrounded by the paddler's link ball lower seat 2504 of the first form paddler's link lower mounting seat 25. The first form paddler's link lower mounting seat is mounted onto the bottom of the paddler's link upper mounting seat 2204 of the first form modified surfboard by the self-locking bolt-nut-washer sets 7. The surfboard seat and handle combination can be inserted into or screwed onto the seat and handle combination mounting hole 2205.

FIGS. 29 and 30 also illustrate the use of the herein disclosed first form surfboard with paddlers (one of the disclosed devices). To use the device, the user needs to be supported on the device, which is on the water surface. Such user needs to set the paddler controller 8 of one paddler at the "high" position and the other paddler controller of the other paddler at the "low" position. The user then places one foot around the top of the paddlers link upper mounting seat to partially support the main weight, and then utilizes the other foot to periodically release and then push backwards on the foot contour 104 of the paddler 1, in imitation of skateboard user's feet on the ground. The paddler which the user pushes and releases is the one for which paddler controller 8 is at the "high" position.

The user may switch the roles of his or her legs, periodically. Before doing this, the user needs to switch the "high/low" positions of the paddler controllers of the paddlers. To raise the paddler controller from a "low" position to a "high" position, the user uses his or her toes to lift up the paddler controller from the bottom of the paddler controller head 801, and pushes its forward until its paddler controller rest 804 can be seated on the upper rim of the paddler controller slot 101. The lift-up of the paddler controller can be stopped by the paddler controller's foot 803, when it reaches the lower rim of the paddler controller slot. This can prevent the paddler controller from being lifted out of the paddler controller slot accidentally during its operation. To lower the paddler controller from a "high" position to a "low" position, the user places his or her toes on the bottom of the paddler controller head to move the paddler controller upwards and backwards, and release it to let it fall down to the "low" position. To lower the paddler controller to the "low" position, the user may simply use his or her heel to push the paddler controller head backwards, thereby to push its paddler controller rest away from the rim of the paddler controller slot.

The slot formed between the paddler's link upper recessed surface 220401 and the paddler's link lower recessed surface 2501 enables the first form paddler's link arm 1601 to move horizontally freely while it is pivoting on ball 1602. Together, that ball, the ball upper seat 220402 and the ball lower seat form a ball-joint assembly. The paddler's link upper mounting seat inclined surfaces 2220402 and the paddler's link lower mounting seat inclined surfaces 2502 provide some vertical movement freedom to the first form paddler-link assembly, so that the modified surfboard 2201 will not rock when the paddlers are being pushed.

Operationally, when the paddler is not pushed backwards, its paddle will float up, so that the back plate 403 is at about horizontal position and the tilt-up plate 404 is inclining downwards. When the paddler is pushed backwards, the reaction forces of water on the tilt-up plate will cause the paddle to "open" up, initially. Then, the reaction forces on the tilt-up plate and the backplate will cause the paddle to continually "open" up until the upper edge of the back plate meet the bottom of the paddler. The back plate is then at near vertical position. As the paddler continues to be pushed backwards, the backplate will push the water backwards and the entire first form surfboard with paddlers 28, and the user, will move forwards. Because the entire device is moving forwards, the water resistances on the "lowered" paddler controller of the other paddler serves to push this paddler backwards. When the paddler is released by the foot, it will be pushed forward by the other paddler which has a paddler controller at "low" position. The paddlers will pivot on the ball 1602. When the paddler having a paddler controller in "high" position is pivoting forward, its paddle will be pushed upwards. Together with the push and the buoyancy, the backplate of this paddle will be at about horizontal position which is the starting position of the whole process. The entire process can be repeated again and again.

The user may set the paddler controller of each of the paddlers at "high" position. With this setting, the user places a foot on top of each of the paddlers. The surfer's foot can slide forward and push backwards upon turns of the paddles, in a manner similar to the foot and leg motion of cross country skiers. The surfer may insert or attach the optional surfboard seat and handle combination in any suitable optional mounting hole or holes to form a seat or a handle for comfort in using the device.

Referring to FIGS. 34 and 36, a second form paddler's link lower mounting seat 34 comprises a short cylinder with a lower mounting seat mounting hole 3401 along its axis and a mounting slot 3402 at its bottom.

Referring to FIGS. 37, 38 and 39, a second form modified surfboard 37 comprises a modified surfboard 3701, a narrowed waist portion 3702, an optional fin 3703, a paddler's link upper mounting seat 3704, and one or more optional seat and handle combination mounting hole or holes 3705. The modified surfboard incorporates elements 3702, 3703, 3704 and 3705. Its narrowed waist portion is at the middle section of the modified surfboard. Near the middle of the narrowed waist is the paddler's link upper mounting seat which comprises a lower mounting seat hole 370401 and an upper mounting seat mounting hole 370402. The lower mounting seat hole is hollow and has two concave surfaces. In the center of the hole 370401 is mounting hole 370402 which penetrates the paddler's link upper mounting seat, and has an enlarged portion on its top for reception of a bolt head, a nut and/or washer. An optional seat and handle combination mounting hole may have female screw threads, and is at the center line of the top of the modified surfboard. An optional fin is at the bottom of the modified surfboard.

Referring to FIGS. 40, 41 and 42, the second form paddler-link assembly 40 comprises two paddler assemblies 10, which are mirror images of each other, a second form paddler's link 31, and a pair of self-locking bolt-nut-washer sets 7. Each end of the second form paddler's link arm 3104 penetrates into each paddler's link slot 102 of each paddler assembly. Each bolt-nut-washer set penetrates the paddler's link fastening hole 103 and the hole 3102 or 3101 and connects the paddler assembly and the second form paddler's link together. Each paddler assembly can pivot on a bolt-nut-washer set. The maximum pivot angle is limited by the edges of the paddler's link slot.

Referring to FIGS. 43, 44 and 45, a second form surfboard with paddlers comprises a second form modified surfboard 37, a paddler-link assembly 40, a paddler's link lower mounting seat 34, one or more optional surfboard seat and handle combinations, and one self-locking bolt-nut-washer set 7. To assemble the surfboard 37 with paddlers, the second form paddler's link arm 3104 of assembly 40 is first placed into the mounting slot 3402 of a second form paddler's link lower mounting seat 34. Then, the second form paddler's link lower mounting seat is placed into the upper mounting seat 3704. A self-locking bolt-nut-washer set 7 penetrates the bolt hole 3101, the lower mounting seat mounting hole 3401, and the upper mounting seat mounting hole 370402, to lock them together. The surfboard seat and handle combination can be inserted into or screwed into the seat and handle mounting hole 2205.

The described second form surfboard with paddlers is used in the same way as described earlier for the first form surfboard with paddlers.

Referring to FIGS. 46 and 47, a third form paddler's link mounting part 46 consists of a suction head or cup 4601 and a part stem 4602. At the bottom center of the suction head is a part stem which is a rod with a mounting stem 460201 at its free end and with a mounting rod hole 460202 near its tip. The mounting stem has a smaller diameter than the upper portion of the rest of the part stem. The mounting rod hole is penetrated by rod.

Referring to FIG. 48, a pin 48 has two legs. One leg of the pin has a curved section.

Referring to FIG. 49, a mounting rod 49 is a small rod with two pin holes 4901, penetrated and located near each end of the rod.

Referring to FIGS. 50 and 51, a mounting pad has smooth surfaces.

Referring to FIG. 52, a third form paddler-link assembly 52 includes third form paddler-link assembly 40, a third form paddlers link mounting part 46, a mounting rod 49, a pair of washers 5201, and a pair of pins 48. To assemble, the mounting stem 460201 of a third form paddler's link mounting part penetrates a washer 5201, the paddler's link bolt hole 3101, and another washer 5201. Then, the mounting rod is inserted into the mounting rod hole 460202 behind the second washer. One leg of each of the pins 48 is inserted into each of the pin hole 4901.

Referring to FIGS. 53 and 54, the third form paddler-link assembly can be mounted on an ordinary surfboard. To accomplish this, mounting pad 50 is glued onto the bottom of the surfboard. Then the suction head 4601 of the third form paddler-link assembly is pushed onto the mounting pad. The suction action of the suction head keeps the third form paddler-link assembly attached to the surfboard.

The third form surfboard with paddlers is used in the same way as described earlier for on the first form surfboard with paddlers.

I claim:

1. In a surfboard assembly, the combination comprising a) longitudinally forwardly elongated structure including flotation means, and having opposite ends, and b) other means carried by said structure to i) support one foot of a surfer, and ii) to be manually operated by the other foot of the surfer to propel the surfboard assembly forwardly, c) said other means including foot operated paddlers at opposite sides of the elongated structure, and each movable between lowered position in which the paddler pushes rearwardly against water resistance to a raised position in which the paddler moves relatively forwardly, d) and a paddler controller located frontwardly of one raised paddle and projecting downwardly into the water, the paddler controller having an upper position projecting above a top level of said structure and angled to be foot operated to raise and lower that controller.

2. The combination of claim 1 including a link pivotably carried by said structure and interconnecting said paddlers.

3. The combination of claim 2 including foot-rests above the paddlers and to which the link has pivotal interconnection.

4. The combination of claim 2 wherein the structure has a narrowed waist region, and a ball joint on said region and supporting the link intermediate its opposite ends to pivot about a generally vertical axis.

5. In a surfboard assembly, the combination comprising a) longitudinally forwardly elongated structure including flotation means, and having opposite ends, and b) means carried by said structure to i) support one foot of a surfer, and ii) to be manually operated by the other foot of the surfer to propel the surfboard assembly forwardly, c) said means including foot operated paddlers at opposite sides of the elongated structure, and each movable between lowered position in which the paddle pushes rearwardly against water resistance to a raised position in which the paddle moves relatively forwardly, d) there being a link pivotably carried by said structure and interconnecting said paddlers, e) there being foot-rests above the paddlers and to which the link has pivotal interconnection, f) and wherein each paddler has pivotal connection to a foot rest, to pivot about a generally horizontal axis.

6. The combination of claim 1 including another and like paddler controller carried by the structure to extend forwardly of the other paddler, and to be raised and lowered.

7. The combination of claim 5 including a paddler controller associated with and movable forwardly and rearwardly with each foot rest, the controller located frontwardly of the paddle associated with that foot rest.

8. The combination of claim 7 wherein each paddler controller has an upper position projecting above a top level of said structure and angled to be foot operated to raise and lower that controller.

9. The combination of claim 1 including suction means attaching said other means to said structure.

* * * * *